US008715390B2

(12) United States Patent
Schmidt et al.

(10) Patent No.: US 8,715,390 B2
(45) Date of Patent: May 6, 2014

(54) METHOD OF SEPARATING OFF TRACE COMPONENTS FROM A FRACTION CONTAINING AT LEAST NITROGEN AND HELIUM

(75) Inventors: Hans Schmidt, Wolfratshausen (DE); Klaus Ohlig, Winterthur (CH); Ulrich Lindemann, Reichenau (DE); Peter Re, Lane Cove (AU); Hung Nguyen, Turramurra (AU)

(73) Assignee: Linde Aktiengesellschaft, Munich (DE)

( * ) Notice: Subject to any disclaimer, the term of this patent is extended or adjusted under 35 U.S.C. 154(b) by 144 days.

(21) Appl. No.: 13/367,484

(22) Filed: Feb. 7, 2012

(65) Prior Publication Data

US 2012/0198997 A1 Aug. 9, 2012

(30) Foreign Application Priority Data

Feb. 8, 2011 (DE) ..... 10 2011 010 634

(51) Int. Cl.

| | |
|---|---|
| ***B01D 5/00*** | (2006.01) |
| ***F25J 3/02*** | (2006.01) |
| ***F25J 1/00*** | (2006.01) |
| ***F25J 3/00*** | (2006.01) |
| ***F25J 3/06*** | (2006.01) |
| ***F25J 3/08*** | (2006.01) |

(52) U.S. Cl.

USPC ..... 95/39; 203/98; 62/55.5; 62/617; 62/639; 62/927; 62/933

(58) Field of Classification Search

USPC ..... 95/90, 213, 232, 288

See application file for complete search history.

(56) References Cited

U.S. PATENT DOCUMENTS

| | | | | |
|---|---|---|---|---|
| 5,771,714 | A * | 6/1998 | Emley et al. | 62/639 |
| 2009/0013718 | A1 * | 1/2009 | Schmidt | 62/639 |

* cited by examiner

*Primary Examiner* — Duane Smith
*Assistant Examiner* — Cabrena Holecek
(74) *Attorney, Agent, or Firm* — Millen, White, Zelano & Branigan, P.C.

(57) ABSTRACT

A method is described for separating off trace components from a fraction (1) containing at least nitrogen and helium, wherein this fraction is partially condensed (E) before enrichment of the helium. The partially condensed fraction (2) is fed at least in part to at least one separation column (T) and separated therein into a helium-rich gas fraction (6) and a nitrogen-rich liquid fraction which also contains the unwanted trace components (5).

10 Claims, 1 Drawing Sheet

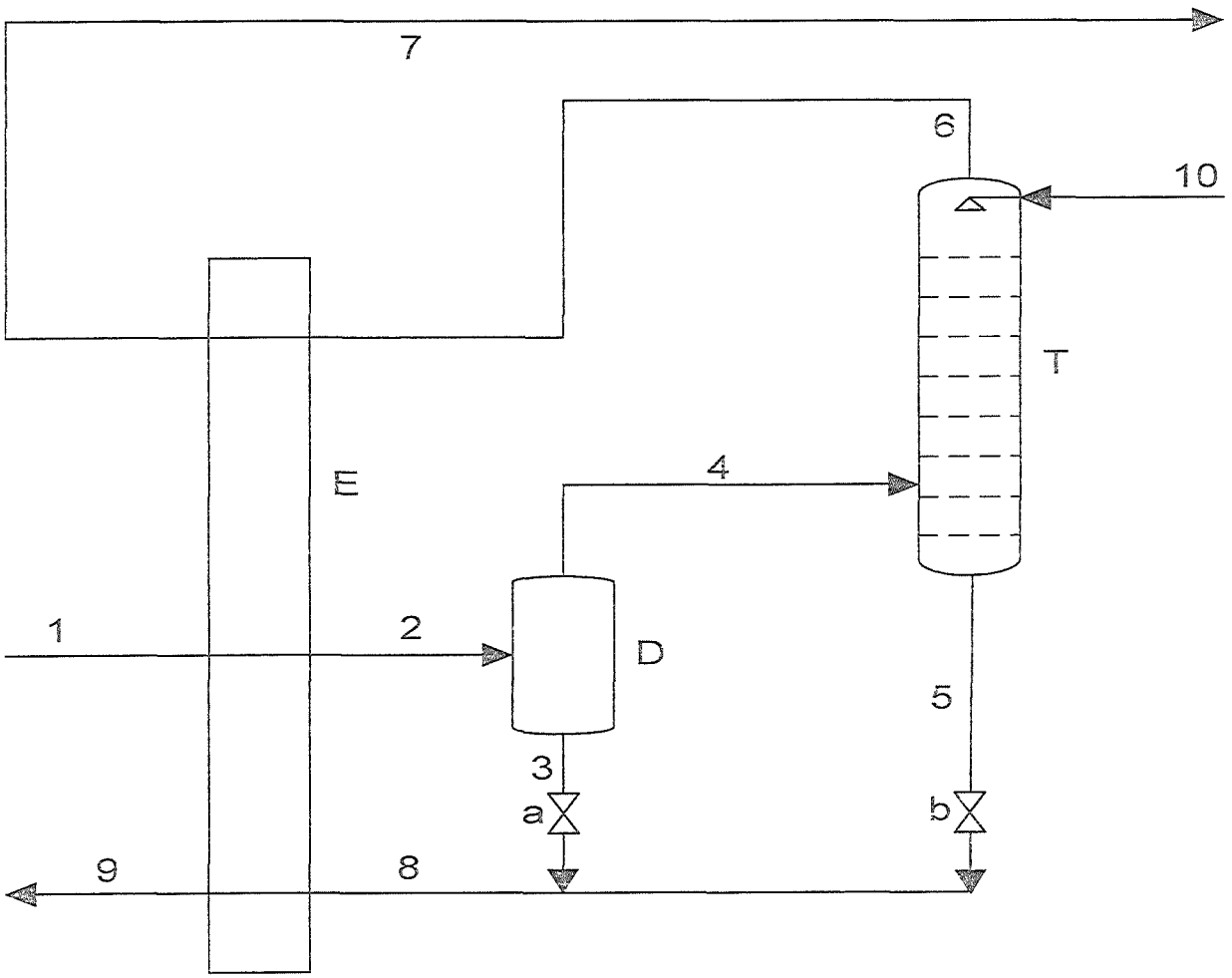
10
T
6
5
b
4
D
3
a
7
2
8
E
1
9

METHOD OF SEPARATING OFF TRACE COMPONENTS FROM A FRACTION CONTAINING AT LEAST NITROGEN AND HELIUM

SUMMARY OF THE INVENTION

The invention relates to a method for separating off trace components from a fraction containing at least nitrogen and helium, wherein this fraction is partially condensed for the enrichment of the helium.

Methods of the type in question for separating off trace components from a fraction containing at least nitrogen and helium are used, for example, in the recovery of helium from natural gas.

As typical trace components, in particular methane, ethane, hydrogen, ethylene, oxygen, and argon come into consideration. In fractions containing nitrogen and helium that are used in helium recovery, the typical concentrations of these trace components are, for example, up to 5% methane, up to 0.5% ethane, up to 0.5% ethylene, up to 0.1% oxygen, up to 0.5% argon, and up to 0.1% hydrogen.

The fraction containing at least nitrogen and helium is usually, during the cooling and liquefaction process of a natural gas stream, separated off therefrom and processed to form a helium-enriched stream which, in the present case, is the desired product stream. Separating off nitrogen and optionally other components such as, for example, methane, oxygen etc., from the fraction containing at least nitrogen and helium usually proceeds after partial condensation in a separator vessel or separator. Separation of the individual components of the fraction containing at least nitrogen or helium proceeds in accordance with the thermodynamic equilibrium at the prevailing temperature and the prevailing pressure of the mixture. The liquefied portions of the nitrogen—and also optionally of the methane and/or oxygen—are taken off in this case from the bottom phase of the separator, whereas the portion remaining gaseous and which consists of nitrogen, helium and traces of methane, oxygen, etc., is taken off at the top of the separator.

In addition to the thermodynamic equilibrium, flow effects cause that liquid droplets are carried along or entrained in the gas phase. In total, the gas phase taken off at the top of the separator can comprise a comparatively high residual contamination of methane, oxygen, etc. In the further course of concentrating the helium from the gas phase of the separator, a liquid nitrogen fraction (LIN) is taken off as product. Usually high requirements are made of this product fraction with respect to the purity of combustible components, here methane and oxygen.

There is therefore a requirement to specify a method for separating off unwanted trace components from a fraction containing at least nitrogen and helium, which method avoids the abovementioned disadvantages and makes possible a sufficient quality of the abovementioned LIN product of the system compared with the known prior art.

Upon further study of the specification and appended claims, other objects and advantages of the invention will become apparent.

These objects are achieved by a method of the type in question for separating off trace components from a fraction containing at least nitrogen and helium which is characterized in that the partially condensed fraction is fed at least in part to at least one separation column and separated therein into a helium-rich gas fraction and a nitrogen-rich liquid fraction which contains the trace components. For example, the helium-rich gas can contain less than 0.5% methane, up to 0.1% oxygen, and up to 0.1% argon.

According to the invention, the separation of the fraction containing at least nitrogen and helium into a helium-enriched gas fraction and a nitrogen-rich liquid fraction proceeds in at least one separation column, wherein the abovementioned fraction is fed to the separation column in the bottom region, preferably in the sump of the separation column. Preferably, the separation column is provided with a plurality of bubble-cap trays and/or ordered or structured packings, whereby the effectiveness of the separation process proceeding therein is increased. Advantageously, a cold reflux medium is fed to the separation column top and distributed therein.

Further advantageous embodiments of the method according to the invention are characterized in that

- the partially condensed fraction is first fed to a separator and the helium-enriched gas fraction obtained from the separator is fed at least in part to the at least one separation column,
- nitrogen or a nitrogen-rich fraction as reflux medium is fed to the separation column, and
- the separation task within the separation column is supported by ordered packings and/or bubble-cap trays arranged therein.

BRIEF DESCRIPTION OF THE DRAWINGS

The invention is illustrated schematically with reference to an exemplary embodiment in the drawing and will be described extensively hereinafter with reference to the drawing. Various other features and attendant advantages of the present invention will be more fully appreciated as the same becomes better understood when considered in conjunction with the accompanying drawing wherein:

the FIGURE illustrates an exemplary embodiment of the invention.

In the embodiment of the method according to the invention shown in the FIGURE, a separator D is connected upstream of the separation column T that is to be provided according to the invention. This separator can alternatively be integrated in the lower part of the separation column, preferably in the bottom part thereof.

The fraction 1 containing at least nitrogen and helium that is to be separated contains only a few percent of methane and helium and optionally a few parts per thousand of oxygen, argon and hydrogen, and the remainder is nitrogen. This fraction has a temperature of above 300 K and is cooled to a temperature of approximately 80 K in the heat exchanger E in countercurrent to process streams which are to be warmed, and which will be considered in more detail hereinafter. The cooled fraction is fed via line 2 to the separator D. From the bottom phase thereof, a first nitrogen-rich fraction is taken off via line 3 and cold-producingly expanded in the expansion valve a. In comparison to the feed fraction 1, the first nitrogen-rich fraction is enriched with regards to the concentrations of methane and oxygen. At the top of the separator D, a helium-enriched fraction is taken off via line 4 and delivered to the separation column T in the lower region thereof.

As already mentioned, a plurality of ordered packings and/or bubble-cap trays—shown by the dashed lines—are arranged within the separation column T for the purpose of increasing the efficacy of the separation process. Via line 10, a cold reflux medium is fed to the top of the separation column T; this is preferably liquid nitrogen or a nitrogen-rich liquid fraction.

A second nitrogen-rich fraction is taken off from the bottom phase of the separation column T via line 5, cold-producingly expanded in the valve b and combined with the first nitrogen-rich fraction 3 to form stream 8. This stream is warmed in the heat exchanger E against the feed fraction 1 that is to be cooled and then, via line 9, or preferably after combustion of the methane, delivered to the atmosphere. In comparison to helium-enriched fraction 4, the second nitrogen-rich fraction is enriched with regards to the concentrations of methane and oxygen.

At the top of the separation column T, via line 6, a nitrogen- and helium-rich fraction 6 is taken off. The methane, oxygen and hydrogen content thereof are in the parts per thousand range, whereas it comprises helium in accordance with the content in the feed fraction 1. The fraction 6, in the heat exchanger E, is likewise warmed against the feed fraction 1 that is to be cooled and fed via line 7 to further use thereof, for example in a further enrichment and liquefaction of the helium which are not shown in the figure.

The method according to the invention for separating off trace components from a fraction containing at least nitrogen and helium is a more effective separation and purification method, compared with the known prior art and, furthermore, saves energy and also costs. The amount of reflux medium or additional liquid nitrogen for the reflux 10 of the separation column T can be adapted to the respective feed conditions, from which a considerable saving in operating costs results. Compared with a simple separator, the operating costs of the separation column to be provided according to the invention are not higher. Complex post-purification processes required to date can now be simplified or even dispensed with.

In the above-described process procedure, the abovementioned components methane and oxygen are separated off together with the nitrogen as bottom phase product of the separation column T. If the nitrogen-rich fraction(s) obtained from the overhead product of the separation column T is (are) to be liquefied and used, for example, within the further process as cooling medium, attention must be paid to the fact that, owing to the concentration of methane and/or oxygen, an explosive or combustible gas mixture can be formed.

These unwanted trace components can now be eliminated from the helium-rich product stream that is taken off at the top of the separation column relatively early from the actual purification process by way of the separation column that is to be provided according to the invention. This means that in the further course of the treatment of this product stream they need no longer be taken into account as is the case in the separation and purification methods coming under the prior art.

The entire disclosure[s] of all applications, patents and publications, cited herein and of corresponding German Application No. DE 10 2011 010 634.0, filed Feb. 8, 2011 are incorporated by reference herein.

The preceding examples can be repeated with similar success by substituting the generically or specifically described reactants and/or operating conditions of this invention for those used in the preceding examples.

The invention claimed is:

1. A method for separating off trace components from a fraction (1) containing at least nitrogen and helium, said method comprising:

partially condensing (E) said fraction (1), feeding at least part of the partially condensed fraction (2) into at least one separation column (T) wherein said partially condensed fraction (2) is separated into a helium-rich gas fraction (6) and a nitrogen-rich liquid fraction (5), said nitrogen-rich liquid fraction (5) contains the trace components, and wherein only two streams exit said separation column (T).

2. The method according to claim 1, wherein, before being fed into said at least one separation column (T), said partially condensed fraction (2) is fed to a separator (D), and a helium-enriched gas fraction (4) is removed from said separator (D) and introduced at least in part to said at least one separation column (T).

3. The method according to claim 1, wherein nitrogen is fed into said separation column (T) as reflux medium.

4. The method according to claim 2, wherein nitrogen-rich fraction (10) is fed into said separation column (T) as reflux medium.

5. The method according to claim 1, wherein separation within said separation column (T) is supported by ordered packings and/or bubble-cap trays arranged therein.

6. The method according to claim 2, wherein separation within said separation column (T) is supported by ordered packings and/or bubble-cap trays arranged therein.

7. The method according to claim 3, wherein separation within said separation column (T) is supported by ordered packings and/or bubble-cap trays arranged therein.

8. The method according to claim 4, wherein separation within said separation column (T) is supported by ordered packings and/or bubble-cap trays arranged therein.

9. A method for separating off trace components from a fraction (1) containing at least nitrogen and helium, said method comprising:

partially condensing (E) said fraction (1), feeding at least part of the partially condensed fraction (2) into at least one separation column (T) wherein said partially condensed fraction (2) is separated into a helium-rich gas fraction (6) and a nitrogen-rich liquid fraction (5), said nitrogen-rich liquid fraction (5) contains the trace components, wherein said trace components in fraction (1) comprise up to 5% methane, up to 0.5% ethane, up to 0.5% ethylene, up to 0.1% oxygen, up to 0.5% argon, and up to 0.1% hydrogen.

10. A method for separating off trace components from a fraction (1) containing at least nitrogen and helium, said method comprising:

partially condensing (E) said fraction (1), feeding the at least partially condensed fraction (1) to a separator (D), removing a helium-enriched gas fraction (4) from said separator (D) and introducing said helium-enriched gas fraction (4) to a separation column (T) wherein helium-enriched gas fraction (4) is separated into a helium-rich gas fraction (6) and a nitrogen-rich liquid fraction (5), wherein said nitrogen-rich liquid fraction (5) contains the trace components, and wherein said helium-enriched gas fraction (4) is introduced into said separation column (T) as a solely gaseous stream.

* * * * *